US008745996B2

(12) United States Patent
Qiao et al.

(10) Patent No.: US 8,745,996 B2
(45) Date of Patent: Jun. 10, 2014

(54) HIGH-SIDE PRESSURE CONTROL FOR TRANSCRITICAL REFRIGERATION SYSTEM

(75) Inventors: HongTao Qiao, Shanghai (CN); Hans-Joachim Huff, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 543 days.

(21) Appl. No.: 13/121,824

(22) PCT Filed: Sep. 28, 2009

(86) PCT No.: PCT/US2009/058543

§ 371 (c)(1), (2), (4) Date: Jun. 13, 2011

(87) PCT Pub. No.: WO2010/039630

PCT Pub. Date: Apr. 8, 2010

(65) Prior Publication Data

US 2011/0239668 A1 Oct. 6, 2011

Related U.S. Application Data

(60) Provisional application No. 61/101,782, filed on Oct. 1, 2008.

(51) Int. Cl.
*F25B 1/00* (2006.01)

(52) U.S. Cl.
USPC ..... 62/115; 62/129

(58) Field of Classification Search
CPC ..... F25B 1/00; F25B 9/002; F25B 3/00; F25B 2600/027; F25B 2600/01; F25D 29/00; F25D 27/00; F24F 2011/001
USPC ..... 62/115, 498, 228.3, 229, 231, 129, 208
See application file for complete search history.

(56) References Cited

U.S. PATENT DOCUMENTS

| | | | | |
|---|---|---|---|---|
| 5,245,836 | A | 9/1993 | Lorentzen et al. | |
| 5,497,631 | A | 3/1996 | Lorentzen et al. | |
| 6,343,486 | B1 | 2/2002 | Mizukami | |
| 6,505,476 | B1 * | 1/2003 | Nishida et al. | 62/228.5 |
| 6,523,360 | B2 * | 2/2003 | Watanabe et al. | 62/204 |

(Continued)

FOREIGN PATENT DOCUMENTS

| | | |
|---|---|---|
| JP | 2001194017 | 7/2001 |
| JP | 2002130770 A | 5/2002 |

(Continued)

OTHER PUBLICATIONS

Translation of JP 2001-194017A to Nishida et al.*

(Continued)

*Primary Examiner* — Mohammad M Ali
(74) *Attorney, Agent, or Firm* — Cantor Colburn LLP

(57) ABSTRACT

To accommodate a transcritical vapor compression system with an operating envelope which covers a large range of heat source temperatures, a high side pressure is maintained at a level determined not only by operating conditions at the condenser but also at the evaporator. A control is provided to vary the expansion device in response to various combinations of refrigerant conditions sensed at both the condenser and the evaporator in order to maintain a desired high side pressure.

4 Claims, 4 Drawing Sheets

(56) References Cited

U.S. PATENT DOCUMENTS

| | | | | |
|---|---|---|---|---|
| 6,568,199 | B1 | 5/2003 | Manohar et al. | |
| 6,626,000 | B1 | 9/2003 | Meyer et al. | |
| 6,694,763 | B2 | 2/2004 | Howard | |
| 7,000,413 | B2 | 2/2006 | Chen et al. | |
| 7,051,542 | B2 | 5/2006 | Chen et al. | |
| 7,559,206 | B2 * | 7/2009 | Ohta | 62/160 |
| 8,418,489 | B2 * | 4/2013 | Okamoto | 62/222 |
| 2002/0050143 | A1 * | 5/2002 | Watanabe et al. | 62/204 |
| 2006/0230773 | A1 | 10/2006 | Park | |
| 2007/0028633 | A1 | 2/2007 | Suzuki et al. | |
| 2007/0125106 | A1 * | 6/2007 | Ishikawa et al. | 62/183 |
| 2008/0022706 | A1 | 1/2008 | Sakimichi et al. | |

FOREIGN PATENT DOCUMENTS

| | | |
|---|---|---|
| JP | 2006132875 | 5/2006 |
| JP | 2006153349 | 6/2006 |
| JP | 2007038971 | 2/2007 |
| KR | 20040073325 | 8/2004 |
| WO | 2010039630 | 4/2010 |

OTHER PUBLICATIONS

International Search Report and Written Opinion mailed May 4, 2010.

International Preliminary Report oon Patentability mailed Apr. 14, 2011.

* cited by examiner

HIGH-SIDE PRESSURE CONTROL FOR TRANSCRITICAL REFRIGERATION SYSTEM

TECHNICAL FIELD

This invention relates generally to transport refrigeration systems and, more particularly, to a method and apparatus for optimizing the system high-side pressure in a $CO_2$ vapor compression system with a large range of evaporating pressures.

BACKGROUND OF THE INVENTION

The operation of vapor compression systems with $CO_2$ as the refrigerant is characterized by the low critical temperature of $CO_2$ at approximately 31° C. At many operating conditions, the critical temperature of $CO_2$ is lower than the temperature of the heat sink, which results in a transcritical operation of the vapor compression system. In the transcritical operation the heat rejection occurs at a pressure above the critical pressure, and the heat absorption occurs at a pressure below the critical pressure. The most significant consequence of this operating mode is that pressure and temperature during the heat rejection process are not coupled by a phase change process. This is distinctly different from conventional vapor compression systems, where the condensing pressure is linked to the condensing temperature, which is determined by the temperature of the heat sink. In transcritical vapor compression systems, the refrigerant pressure during heat rejection can be freely chosen, independent of the temperature of the heat sink. However, given a set of boundary conditions (temperatures of heat sink and source, compressor performance, heat exchanger size, and line pressure drops) there is a first "optimum" heat rejection pressure, at which the energy efficiency of the system reaches its maximum value for this set of boundary conditions. There is also a second "optimum" heat rejection pressure, at which the cooling capacity of the system reaches its maximum value for this set of boundary conditions. The existence of these optimum pressures has been documented in the open literature. For example, maximum energy efficiency is attained in U.S. Pat. Nos. 6,568,199 and 7,000,413, and maximum heating capacity is attained in U.S. Pat. No. 7,051,542, all of which are assigned to the assignee of the present invention.

Given a set of boundary conditions (temperature of heat source, compressor performance, heat exchanger size, and line pressure drops), the value of the optimum heat rejection pressure depends primarily on the temperature of the heat sink. Conventional control schemes for $CO_2$ systems utilize the refrigerant temperature at the heat rejection heat exchanger outlet or the heat sink temperature or any indicator of these as the control input to control the heat rejection pressure. However, in systems designed for an operating envelope which covers a large range of heat source temperatures (e.g. −20 F to 57 F), such as transport refrigeration units, it may not be sufficient to correlate the optimum high-side pressure only to the temperature of the heat sink.

DISCLOSURE OF THE INVENTION

In accordance with one aspect of the invention, in systems having a relatively large range of heat source temperatures, the control of the system high-side pressure in a $CO_2$ vapor compression system is made dependent not only on the condition of refrigerant on the high pressure side (i.e. in the cooler), but also on the condition of refrigerant on the low pressure side (i.e. at the evaporator).

By another aspect of the invention, in addition to temperature conditions sensed at the cooler, various sensed pressure or temperature conditions at the evaporator may be used in various combinations to determine the optimum system high-side pressure.

While the present invention has been particularly shown and described with reference to the preferred mode as illustrated in the drawings, it will be understood by one skilled in the art that various changes in detail may be effected therein without departing from the spirit and scope of the invention as defined by the claims.

DETAILED DESCRIPTION OF THE INVENTION

Figure 1:
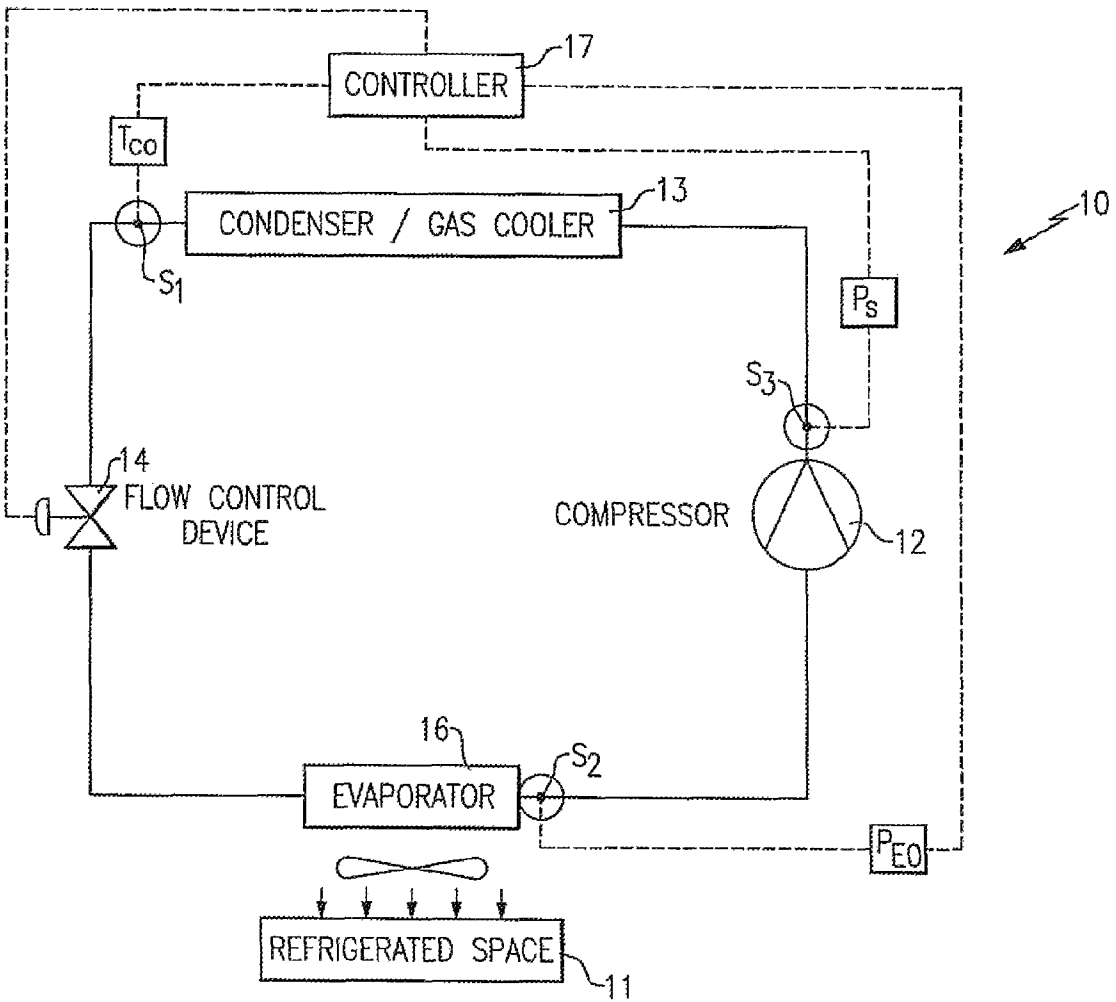
FIG. 1 is a schematic illustration of one embodiment of the invention as incorporated into a transcritical refrigeration system.
Figure 2:
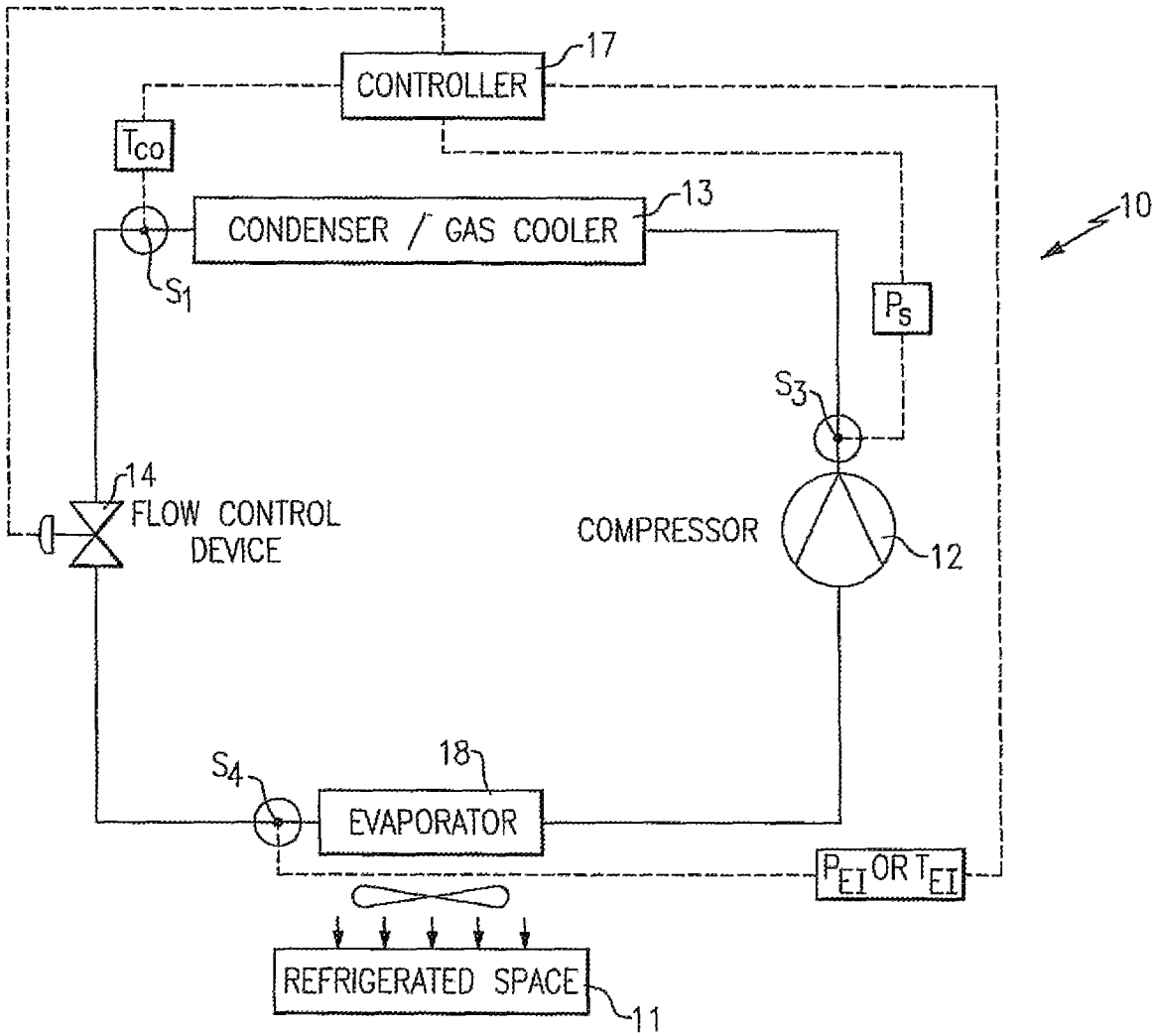
FIG. 2 is a schematic illustration of another embodiment thereof.
Figure 3:
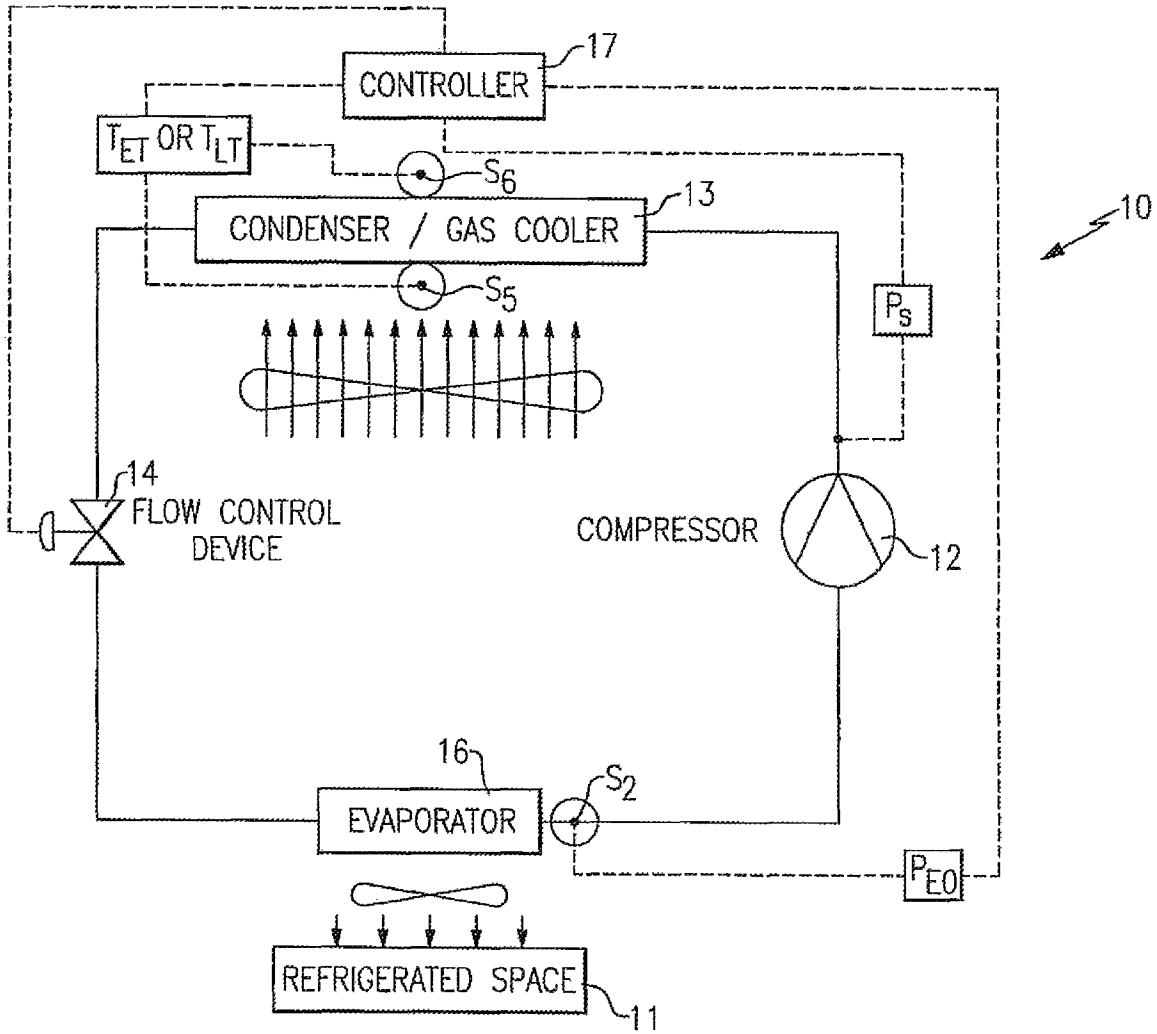
FIG. 3 is a schematic illustration of yet another embodiment thereof.

Referring now to FIGS. 1-3, the refrigerant vapor compression system 10 will be described herein in connection with the refrigeration of a temperature controlled cargo space 11 of a refrigerated container, trailer or truck for transporting perishable items. It should be understood, however, that such a system could also be used in connection with refrigerating air for supply to a refrigerated display merchandiser or cold room associated with a supermarket, convenience store, restaurant or other commercial establishment or for conditioning air to be supplied to a climate controlled comfort zone within a residence, office building, hospital, school, restaurant or other facility. The refrigerant vapor compression system 10 includes a compression device 12, a refrigerant heat rejection heat exchanger commonly referred to as a condenser or gas cooler 13, an expansion device 14 and a refrigerant heat absorption heat exchanger or evaporator 16, all connected in a closed loop, series refrigerant flow arrangement.

Primarily for environmental reasons, the "natural" refrigerant, carbon dioxide is used as the refrigerant in the vapor compression system 10. Because carbon dioxide has a low critical temperature, the vapor compression system 10 is designed for operation in the transcritical pressure regime. That is, transport refrigeration vapor compression systems having an air cooled refrigerant heat rejection heat exchanger operating in environments having ambient air temperatures in excess of the critical temperature point of carbon dioxide, 31.1° C. (88° F.), must operate at a compressor discharge pressure in excess of the critical pressure for carbon dioxide, 7.38 MPa (1070 psia) and therefore will operate in a transcritical cycle. Thus, the heat rejection heat exchanger 13 operates as a gas cooler rather than a condenser and operates at a refrigerant temperature and pressure in excess of the refrigerates critical point, while the evaporator 16 operates at a refrigerant temperature and pressure in the subcritical range.

It is important to regulate the high side pressure of a transcritical vapor compression system as the high pressure has a large effect on the capacity and efficiency of the system. The present system therefore includes various sensors within the vapor compression system 10 to sense the condition of the refrigerant at various points and then control the system to obtain the desired high side pressure to obtain increased capacity and efficiency.

As shown in the embodiment of FIG. 1, the sensors $S_1$, $S_2$ and $S_3$ are provided to sense the condition of the refrigerant at various locations within the vapor compression system 10, with the sensed values then being sent to a controller 17 for determining the ideal high side air pressure, comparing it with the actual sensed high side pressure, and taking appropriate measures to reduce or eliminate the difference therebetween. The sensor $S_1$ senses the outlet temperature. $T_{CO}$ of the condenser 13 and sends a representative signal to the controller 17. The sensor $S_2$ senses the evaporator outlet pressure $P_{EO}$ and sends a representative signal to the controller 17. From those two values, the controller 17 obtains from a lookup table or from an equation/function $P_I=f(T_{S1}, P_{S2})$ an ideal high side pressure. In the meantime, the sensor $S_3$ senses the actual discharge or high side pressure $P_S$ and sends it to the controller 17. A controller 17 then compares the ideal pressure $P_I$ with the sensed pressure $P_S$ and adjusts the expansion device 14 in a manner so as to reduce the difference between those two values. Briefly, if the sensed pressure $P_S$ is lower than the ideal pressure $P_I$, then expansion device 14 is moved toward a closed position, and if the sensed pressure $P_S$ is higher than the ideal pressure $P_I$, then it is moved toward the open position.

Referring now to FIG. 2, an alternative embodiment is shown wherein, the $S_1$ and $S_3$ values are obtained in the same manner as in the FIG. 1 embodiment, but the $S_4$ sensor is placed at the inlet of the evaporator, and the values of either the evaporator inlet pressure $P_{EI}$ or the evaporator inlet temperature $T_{EI}$ are obtained. If the evaporator inlet pressure $P_{IE}$ is sensed, then the value is sent to the controller 17 and an ideal high side pressure is obtained from a different lookup table from the FIG. 1 embodiment. The subsequent steps are then taken in the same manner as described hereinabove with respect to the FIG. 1 embodiment.

If the sensed $S_4$ senses the evaporator inlet temperature $T_{EI}$, then that value is sent to the controller 17 which then enters a lookup table to find the corresponding evaporator inlet pressure $P_{EI}$, and the remaining steps are then taken as described hereinabove.

A further embodiment is shown in FIG. 3 wherein, rather than the condenser outlet temperature $T_{CO}$, being sensed, the sensors $S_5$ and $S_6$ are provided to sense the temperature of the cooling air entering the condenser $T_{ET}$ (i.e. the ambient temperature), and the temperature of the air which is leaving $T_{LT}$ the condenser 13. The controller 17 then determines the ideal high side pressure $P_I$ on the basis of the evaporator outlet pressure $P_{EO}$ and the condenser entering air temperature $T_{ET}$ or on the basis of the $P_{EO}$ and the condenser air leaving temperature $T_{LT}$. The remaining steps are then taken in the manner described hereinabove.

Figure 4:
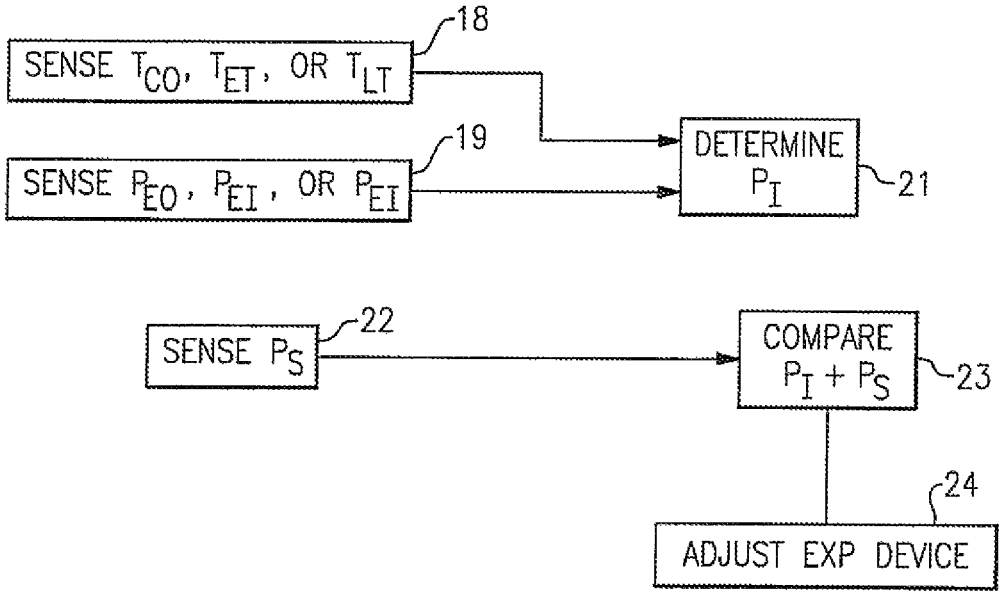
FIG. 4 is a block diagram illustration of the process of the present invention.

A functional diagram for the various sensors and the control 17 is shown in FIG. 4. In block 18, the condenser outlet temperature $T_{CO}$ or the condenser air entering temperature $T_{ET}$, or the condenser air leaving temperature $T_{LT}$ is sensed and passed to the controller 17. In block 19, the evaporator exit pressure $P_{EO}$ the evaporator inlet pressure $P_{EI}$ or the evaporator inlet temperature $T_{EI}$ is sensed and passed to the controller 17. In block 21, the control 17 determines the ideal high side pressure $P_I$ by using two of the values as described above. In the meantime, a compressor discharge pressure or high side pressure $P_S$ is sensed in block 22 and passed to the controller 17. In block 23, the sensed pressure $P_S$ is compared with the ideal high side pressure $P_I$, and the difference is passed to block 24 which responsively adjusts the expansion device 14 in the manner as described hereinabove.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. A transcritical vapor compression system comprising:

a compression device to compress a refrigerant to a high pressure;

a heat rejecting heat exchanger for receiving refrigerant at a heat rejecting heat exchanger inlet temperature and discharging refrigerant at a lower refrigerant outlet temperature and for receiving a cooling fluid at an entering temperature and discharging said fluid at a higher leaving temperature;

an expansion device for reducing said refrigerant to a lower pressure;

a heat accepting heat exchanger for heating and evaporating said refrigerant entering said heat accepting heat exchanger at an inlet pressure and inlet temperature and exiting said heat accepting heat exchanger at an outlet pressure; and a control to determine a desired high pressure of said refrigerant on the basis of one of said temperatures in combination with one of said pressures;

wherein said temperatures are selected from the group consisting of the heat accepting heat exchanger inlet temperature and said pressures are selected from the group consisting of the heat accepting heat exchanger inlet pressure and a compressor outlet pressure.

2. A method of optimizing system high-side pressure in a $CO_2$ vapor compression system comprising the steps of:

compressing a refrigerant to a high pressure;

cooling said refrigerant by giving up heat in said refrigerant to a cooling fluid flowing in a heat sink;

expanding said refrigerant to a low pressure;

evaporating said refrigerant;

determining temperature of said refrigerant prior to evaporating the refrigerant;

determining a pressure of said refrigerant prior to evaporating the refrigerant;

determining a desired high pressure of said refrigerant on the basis of said pressures of said refrigerant prior to evaporating the refrigerant; and adjusting said high pressure to said desired high pressure.

3. A transcritical refrigeration system comprising:

a compression device to compress a refrigerant to a high pressure;

a heat rejecting heat exchanger for cooling said refrigerant by giving up heat to a cooling fluid;

an expansion device for reducing said refrigerant to a low pressure;

a heat accepting heat exchanger for evaporating said refrigerant;

a sensor to sense a pressure of the refrigerant at the inlet of said heat accepting heat exchanger or sense a temperature of the refrigerant at the inlet of said heat accepting heat exchanger; and a control for calculating a value on the basis of said temperature of refrigerant at the inlet of said heat accepting heat exchanger or pressure of the refrigerant at the inlet of said heat accepting heat exchanger and comparing said value with a stored predetermined value to determine a state of efficiency of the refrigeration system and adjust the refrigeration system accordingly.

4. A method of optimizing performance of a refrigeration system comprising:

compressing the refrigerant to a high pressure in a compressor device;

cooling said refrigerant by giving up heat to a cooling fluid of a heat rejecting heat exchanger;

expanding said refrigerant to a low pressure in an expansion device;

evaporating said refrigerant in a heat accepting heat exchanger;

sensing an inlet temperature of said refrigerant just prior to evaporating said refrigerant or sensing inlet pressure of said refrigerant just prior to evaporating said refrigerant;

on the basis of said inlet temperature or said inlet pressure, calculating the value representative of the system operating condition;

comparing said calculated value with a predetermined stored value to determine a state of efficiency of the system; and adjusting said refrigeration system accordingly.

* * * * *